US006187175B1

(12) United States Patent
Blum et al.

(10) Patent No.: US 6,187,175 B1
(45) Date of Patent: Feb. 13, 2001

(54) $CO_2$ TREATMENT TO REMOVE ORGANICALLY BOUND METAL IONS FROM CRUDE

(75) Inventors: Saul Charles Blum, Edison; Guido Sartori, Annandale; Martin Leo Gorbaty, Westfield; David William Savage, Lebanon; David Craig Dalrymple, Bloomsbury; William Edward Wales, Phillipsburg, all of NJ (US)

(73) Assignee: ExxonMobil Research and Engineering Company, Annandale, NJ (US)

( * ) Notice: Under 35 U.S.C. 154(b), the term of this patent shall be extended for 0 days.

(21) Appl. No.: 09/483,943

(22) Filed: Jan. 18, 2000

Related U.S. Application Data

(63) Continuation of application No. 08/961,816, filed on Oct. 31, 1997, now abandoned, which is a continuation of application No. 08/726,014, filed on Oct. 4, 1996, now abandoned.

(51) Int. Cl.[7] ..... C10G 17/08
(52) U.S. Cl. ..... 208/251 R; 208/252
(58) Field of Search ..... 208/251 R, 252

(56) References Cited

U.S. PATENT DOCUMENTS

| | | | | |
|---|---|---|---|---|
| 4,191,639 | * | 3/1980 | Audeh et al. | 208/309 |
| 4,228,002 | * | 10/1980 | Vaidyanathan et al. | 210/729 |
| 4,464,251 | * | 8/1984 | Kukes et al. | 208/221 |
| 4,465,589 | * | 8/1984 | Kukes et al. | 208/208 R |
| 4,518,489 | * | 5/1985 | Hitzman | 208/223 |
| 4,778,591 | | 10/1988 | Reynolds | 206/252 |
| 4,853,109 | | 8/1989 | Reynolds | 208/252 |
| 5,976,358 | * | 11/1999 | Sartori et al. | 208/251 R |
| 6,093,311 | * | 7/2000 | Blum et al. | 208/251 R |

FOREIGN PATENT DOCUMENTS

| | | |
|---|---|---|
| 496779 | 12/1938 | (GB) . |
| WO 98/4534 | 4/1998 | (WO) . |

OTHER PUBLICATIONS

Eckerman, et al., Chem. Eng. Technol. 13(4) (1990) 258–64 – no month.

Funk, Am. Chem. Soc., Div. Fuel Chem. 30(3) (1985) pp. 148, 148a, 149, 149a, 150–153 –no month.

* cited by examiner

*Primary Examiner*—Walter D. Griffin
*Assistant Examiner*—Nadine Preisch
(74) *Attorney, Agent, or Firm*—Linda M. Scuorzo

(57) ABSTRACT

The present invention is a process to remove a +2 ionic charged, organically bound metal from a petroleum feed. The process includes contacting feed with aqueous carbon dioxide in the essential absence for emulsion formation.

9 Claims, No Drawings

$CO_2$ TREATMENT TO REMOVE ORGANICALLY BOUND METAL IONS FROM CRUDE

This application is a Continuation of U.S. Ser. No. 08/961,816, filed Oct. 31, 1997, now abandoned, which is a Continuation of U.S. Ser. No. 08/726,014, filed Oct. 4, 1996, now abandoned.

BACKGROUND OF THE INVENTION

The present invention relates to a process to remove certain organically bound metal ions from crude oil.

Basic metals such as calcium, when present in crudes can lead to fouling of heaters and heat exchangers and poison catalysts used in crude processing. When present as inorganic salts, e.g., chlorides, usually in an oil-encapsulated water phase, the salts can hydrolyze to release corrosive mineral acids. Such salts are customarily removed by refinery desalters. However, oil-soluble metal salts such as naphthenates are not removed by conventional desalting. Therefore, oil-soluble, basic metal-rich crudes are less valuable than crudes with low levels of such metals. A process for metal ion removal enables the increase of the value of such crudes.

Hung et al. used fixed bed catalysts in the presence of hydrogen to remove oil-soluble calcium from hydrocarbon feeds (U.S. Pat. Nos. 4,741,821, 4,830,736, 5,102,852). Reynolds et al. removed calcium and/or iron from hydrocarbon feeds to an aqueous phase using aqueous acid and/or salt solutions of hydroxycarboxylic acids (U.S. Pat. No. 4,778,589), aminocarboxylic acids (U.S. Pat. Nos. 4,778,590; 4,778,592), carbonic acid (U.S. Pat. No. 4,778,591), dibasic carboxylic acids (U.S. Pat. No. 4,853,109), and monobasic carboxylic acids (U.S. Pat. No. 4,988,433). These chemical treatments all required pH adjustment to greater than 2, preferably between 5–9 along with a commercial demulsifier in order to overcome the problem of emulsion formation. In another approach, Eckerman et al. (Chem. Eng. Technol. (1990), 13(4), 258–64) and Funk (Am. Chem. Soc. Div. Fuel Chem., (1985) 30(3), 148, 148a, 149, 149a, 150–3) reported on the use of supercritical $CO_2$ fluid to deasphaltene heavy oils accompanied by some removal of only porphyrin metals (Ni, V) associated with the asphaltenes. As known to those skilled in the art, supercritical $CO_2$ has different properties and different separation selectivity from aqueous $CO_2$. Finally, in the pending application (U.S. Ser. No. 961,816, WO 98 14534, published Apr. 9, 1998), oil-soluble calcium removal was effected with $CO_2$ where no water was added. This treatment maintains one liquid (oil) phase and results in the formation of solid $CaCO_3$ enabling separation from the oil phase.

It would be desirable to develop a process for removing oil-soluble metals such as calcium that addresses and overcomes the problem of emulsion formation without the need to add demulsifier agents and agents to maintain the pH of the solution. Applicants' invention addresses these needs.

SUMMARY OF THE INVENTION

Applicants have discovered a process to remove +2 ionically charged, organically bound metals from a petroleum feed. One embodiment includes the steps of contacting the petroleum feed at a temperature between 40° C. and 200° C. and autogenous pressure with an effective amount of an aqueous solution of $CO_2$ under conditions sufficient to minimize the formation of a crude oil in water emulsion to produce a treated crude having a decreased metals content.

The aqueous $CO_2$ solution is formed by dissolving an effective amount of $CO_2$ in water.

A volume ratio of water to organic phase of greater than 2:1 eliminates emulsion formation. An acidic pH is produced by the addition of the $CO_2$ dissolved in a sufficient volume of water. The aqueous $CO_2$ solution or the individual components thereof may be combined with the petroleum feed within the volume ratios specified herein.

In a preferred embodiment the oil-soluble metal is a Group IIa (alkaline earth) metal. In particular, the oil-soluble metals to be removed are Group IIa metals, Mn, Zn and Fe.

The present invention may comprise, consist or consist essentially of the steps recited herein.

DESCRIPTION OF THE PREFERRED EMBODIMENT

One embodiment of the present invention is a process to remove +2 ionic charged metals from a petroleum feed by adding aqueous carbon dioxide, i.e., a solution formed by dissolving $CO_2$ in an effective amount of water, to a +2 metals-containing petroleum feed in a ratio of aqueous $CO_2$ to petroleum feed effective to avoid emulsion formation. The $CO_2$ typically is added in the form of dry ice in water.

In another embodiment, $CO_2$ in a liquid or gaseous form is used to make the aqueous solution. In another embodiment, the aqueous $CO_2$ solution is made in situ by combining stepwise the petroleum feed with water and solid carbon dioxide. In another embodiment, $CO_2$ is added to the crude and then water is added. In another embodiment, the petroleum feed is added to the aqueous $CO_2$ solution. In another embodiment of the present invention the $CO_2$ and water are co-added with the petroleum feed forming aqueous $CO_2$ in situ. The volume and molar ratios are as specified below. The choice of the method to use depends on the field situation and can be made by one skilled in the art.

The amount of water used in the process of the present invention is in excess of that naturally occurring in the petroleum feed. The volume ratio of water to petroleum feed is preferably equal to or greater than 2:1, more preferably between 2:1 and 10:1, most preferably between 2:1 and 5:1. The molar ratio of $CO_2$ to metal ions is preferably between 500:1 and 2:1, more preferably between 200:1 and 10:1, The oil-soluble metals to be removed include Group Ia metals, notably Ca and Mg, as well as Zn, Fe and Mn. Calcium is particularly important. The metals to be removed may be in several forms, including naphthenates and phenolates.

The reaction is carried out in any suitable reactor, e.g., an autoclave under autogenous pressure. The temperatures should be high enough to permit easy stirring of the crude. The reaction temperature is typically from 40° C. to 200° C. The reaction probably occurs as follows in the petroleum feed, using calcium as an example:

$$(RCOO)_2Ca+2CO_2+2H_2O \rightarrow 2RCOOH+Ca(HCO_3)_2$$

wherein R is any suitable organo or hydrocarbyl group present in the feed, as is known to those skilled in the art.

Applicants' process provides an advantage in comparison to prior art processes in that by mixing the petroleum feed with $CO_2$ and water (i.e., as an aqueous $CO_2$ solution) rather than $CO_2$ as basic salts of carbonic acid, the need to control the pH by treatment with agents is avoided, and the need for addition of a demulsifier is eliminated since the process minimizes the problem of emulsion formation by using a higher volume ratio of water to petroleum feed.

The process produces a treated petroleum feed in the essential absence of emulsion formation and without the need for using an agent to reacidify the solution.

This invention is particularly valuable when a calcium-rich crude is processed in a corrosion-resistant environment, where the increase in acidity accompanying the process of the present invention is not a drawback.

The following examples illustrate the invention.

EXAMPLE 1

The reaction apparatus was a 300-ml Parr autoclave, equipped with stirrer. 25 g of Kome 6/1 crude were put into the autoclave. The crude contained 930 ppm of calcium, 42 ppm of manganese, 935 ppm of potassium and 13 ppm of sodium. 100 ml of water and 2.5 g of solid carbon dioxide (dry ice) were added, then the autoclave was closed rapidly and heated to 80° C. with stirring. After 24 hours the autoclave was cooled and opened. The contents were transferred to a separatory funnel. The oil phase was heated to about 50° C. and centrifuged to remove residual aqueous phase. Then the oil was analyzed and found to contain 67 ppm of calcium, 7 ppm of manganese, 164 ppm of potassium and 6 ppm of sodium.

The aqueous phase was evaporated to dryness, the residue was heated at 100° C. for 3 hours. X-ray examination showed that it consisted mostly of calcium carbonate (calcite), with some potassium chloride.

EXAMPLE 2

The reaction apparatus was the same as in Example 1. 25 g of Kome 6/1, 100 ml of water and 0.25 g of solid carbon dioxide (dry ice) were put into the autoclave, which was then rapidly closed and brought to 80° C. with stirring. After 24 hours the autoclave was opened and the contents were put into a separatory funnel. The oil phase was analyzed and found to contain 311 ppm of calcium, 31 ppm of manganese, 130 ppm of potassium and 4 ppm of sodium.

EXAMPLE 3

The reaction apparatus was the same as in Example 1. 25 g of Kome 6/1, 100 g of water and 5 g of solid carbon dioxide (dry ice) were put into the autoclave, which was then quickly sealed and heated to 80° C. with agitation. After 24 hours the autoclave was cooled and the contents were transferred to a separatory funnel. The oil phase was centrifuged to remove residual aqueous phase, then analyzed. It contained 50 ppm of calcium, 2.3 ppm of manganese, 195 ppm of potassium and 5.5 ppm of sodium.

EXAMPLE 4

The reaction apparatus was the same as in Example 1. 33 g of Kome 6/1, 100 g of water and 3.3 g of solid carbon dioxide (dry ice) were put into the autoclave, which was then quickly closed and heated to 80° C. with agitation. After 24 hours the autoclave was cooled and the contents were transferred to a separatory funnel. The oil phase was centrifuged to remove residual aqueous phase. The oil phase contained 90 ppm of calcium, 4.7 ppm of manganese, 180 ppm of potassium and 3.3 ppm of sodium.

EXAMPLE 5

The reaction apparatus was the same as in Example 1. 33 g of Kome 6/1, 100 ml of water and 6.6 g of solid carbon dioxide (dry ice) were put into the autoclave, which was then rapidly closed and brought to 80° C. with stirring. After 24 hours the autoclave was opened and the contents were put into a separatory funnel. The oil phase was analyzed and found to contain 33 ppm of calcium, 1.4 ppm of manganese, 67 ppm of potassium and 3.6 ppm of sodium.

EXAMPLE 6

The reaction apparatus was the same as in Example 1. 33 g of Kome 6/1 and 33 ml of water were mixed at room temperature. An emulsion formed. The emulsion along with 66 ml of water and 6.6 g of solid carbon dioxide were put into the autoclave, which was then rapidly closed and brought to 80° C. with stirring. After 24 hours the autoclave was opened and the contents were put into a separatory funnel. The initial emulsion had been broken. The oil phase was analyzed and found to contain 17 ppm of calcium, 2 ppm of manganese, 79 ppm of potassium and 5 ppm of sodium.

EXAMPLE 7

The reaction apparatus was the same as in Example 1. 100 g of Kome 6/1 and 20 ml of water were mixed at 60° C. overnight. An emulsion formed. 41.25 g of the emulsion along with 90.75 ml of water and 6.6 g of solid carbon dioxide (dry ice) were put into the autoclave, which was then rapidly closed and brought to 80° C. with stirring. After 24 hours the autoclave was opened and the contents were put into a separatory funnel. The initial emulsion had been broken. The oil phase was analyzed and found to contain 81 ppm of calcium, 15 ppm of manganese, 120 ppm of potassium and 6 ppm of sodium. Examples 6 and 7 show the criticality of using a water:crude volume ratio of at least 2:1 to prevent emulsion formation.

EXAMPLE 8

The reaction apparatus was the same as in Example 1. 33 g of Kome 6/1, 100 ml of water and 6.6 g of solid carbon dioxide (dry ice) were put into the autoclave, which was then rapidly closed and brought to 80° C. with stirring. After 2 hours the autoclave was opened and the contents were put into a separatory funnel. The oil phase was analyzed and found to contain 93 ppm of calcium 2.7 ppm of manganese, 215 ppm of potassium and 10 ppm of sodium.

EXAMPLE 9

The reaction apparatus was the same as in Example 1. 21.2 g of Kome 6/1, 3.8 g of Bolobo 2/5 (containing 33 ppm of calcium, 12 ppm of manganese, 133 ppm of potassium and 16 ppm of sodium), 100 ml of water and 2.5 g of solid carbon dioxide (dry ice) were put into the autoclave, which was then rapidly closed and brought to 80° C. with stirring. After 24 hours the autoclave was opened and the contents were put into a separatory funnel. The oil phase was analyzed and found to contain 36 ppm of calcium, 4.5 ppm of manganese, 44 ppm of potassium and 4.5 ppm of sodium.

EXAMPLE 10

The reaction apparatus was the same as in Example 1. 25 g of Kome 6/1 and 100 g of water were put into the autoclave. 5 g of solid carbon dioxide (dry ice) were added, then the autoclave was closed rapidly and heated to 80° C. with stirring. After 24 hours the autoclave was cooled and the contents were transferred to a separatory funnel. The oil phase was separated and centrifuged to remove the last traces of aqueous phase. Elemental analysis gave 50 ppm of calcium, 2.3 ppm of manganese, 185 ppm of potassium and 5.5 ppm of sodium.

EXAMPLE 11

The reaction apparatus was the same autoclave used in Example 1. 25 g of Kome 6/1 and 100 g of water were put into the autoclave. 2.5 g of solid carbon dioxide (dry ice) were added, then the autoclave was closed rapidly and heated to 40° C. with stirring. After 24 hours the autoclave was cooled and the contents were transferred to a separatory funnel. Elemental analysis of the oil phase gave 166 ppm of calcium, 3.2 ppm of manganese, 375 ppm of potassium and 10.4 ppm of sodium.

EXAMPLE 12

The reaction apparatus was the same autoclave described in Example 1. 21.2 g of Kome 6/1, 3.8 g of Bolobo 2/5 and 100 g of water were put into the autoclave. 2.5 g of solid carbon dioxide (dry ice) was added, then the autoclave was closed rapidly and heated to 80° C. with stirring. After 24 hours the autoclave was cooled to room temperature. Agitation was stopped. After 5 days the autoclave was opened and the contents transferred to a separatory funnel. Elemental analysis of the oil phase gave 1.67 ppm of calcium, 2.3 ppm of manganese, 88 ppm of potassium and 3.5 ppm of sodium.

EXAMPLE 13

The following example is only for comparison.

The reaction apparatus was the same as in Example 1. 100 g of Kome 6/1 crude were put into the autoclave. 9.9 g of solid $CO_2$ (dry ice) were added, then the autoclave was sealed quickly and slowly brought to 80° C., where it was kept for 24 hours.

After cooling, excess $CO_2$ was vented, the autoclave was opened and solids were separated from the oil by centrifugation. The oil contained 187 ppm of Ca, 8.8 ppm of Mn, 9.8 ppm of Na and 658 ppm of K.

Comparison with Example 1, in which the same $CO_2$/Kome ratio and the same reaction time were used, shows that water addition leads to a more complete removal of the metals.

EXAMPLE 14

The purpose of this example was to show the effect of the water/oil ratio on whether an emulsion forms or not.

The reaction apparatus was the same as in example 1. 50 g of Kome 6/1 crude oil and 50 g of de-ionized water were put into the autoclave, which was then closed. The mixture was stirred at room temperature overnight.

The emulsion so formed was transferred to a separatory funnel and left there until the following day. The emulsion did not break. It was put back into the autoclave and stirred at 80° C. overnight. After cooling, the autoclave contents were transferred back to the separatory funnel. The emulsion had not broken. This showed that thermal treatment alone was not enough to break the emulsion. The separatory funnel contents were put back into the autoclave, together with 100 g of water. Then 10 g of solid carbon dioxide (dry ice) were added, the autoclave was rapidly closed, heated with stirring to 80° C. and kept there for 24 hours. After cooling, the autoclave contents were transferred back to the separatory funnel. There was immediate separation between the oil and aqueous phases. The oil phase was analyzed and found to contain 85 ppm of calcium, 8.4 ppm of manganese, 149 ppm of potassium and 6.7 ppm of sodium.

This shows that a sufficiently high water/oil volume ratio breaks the emulsion without the need for a demulsifier.

What is claimed is:

1. A process to remove a +2 ionic charged metal from the organic phase of a petroleum feed comprising contacting said feed with an aqueous carbon dioxide solution and at a temperature between 40° C. and 200° C. and autogenous pressure to produce a demetalated crude in the essential absence of emulsion formation and an aqueous stream enriched in metallic bicarbonates.

2. The process of claim 1 wherein said metal is selected from Group IIa metals and Mn, Zn and Fe.

3. The process of claim 1 wherein the metal is selected from calcium and magnesium.

4. The process of claim 1 wherein said charged metal is in the form of naphthenates.

5. The process of claim 1 wherein said charged metal is in the form of phenolates.

6. The process of claim 1 wherein the volume ratio of water to feed is between 2:1 and 10:1.

7. The process of claim 1 wherein the molar ratio of $CO_2$ to metal ion is from 2:1 to 500:1.

8. The process of claim 1 wherein the aqueous $CO_2$ solution is formed by premixing water and $CO_2$, then mixed with the feed.

9. The process of claim 1 wherein the aqueous carbon dioxide solution is generated within the petroleum feed from $CO_2$ and water.

* * * * *